US008525740B2

(12) United States Patent
Jeong et al.

(10) Patent No.: US 8,525,740 B2
(45) Date of Patent: Sep. 3, 2013

(54) MOBILE TERMINAL

(75) Inventors: Younsuk Jeong, Gyeonggi-Do (KR); Wooyoung Choi, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 350 days.

(21) Appl. No.: 12/939,907

(22) Filed: Nov. 4, 2010

(65) Prior Publication Data

US 2011/0156962 A1 Jun. 30, 2011

(30) Foreign Application Priority Data

Dec. 30, 2009 (KR) ..... 10-2009-0134762

(51) Int. Cl.
*H01Q 1/24* (2006.01)

(52) U.S. Cl.
USPC ..... 343/702; 343/846; 343/848

(58) Field of Classification Search
USPC ..... 343/702, 846, 848
See application file for complete search history.

(56) References Cited

U.S. PATENT DOCUMENTS

| | | | | |
|---|---|---|---|---|
| 7,505,006 | B2 * | 3/2009 | Ollikainen et al. | 343/702 |
| 7,903,034 | B2 * | 3/2011 | Anguera et al. | 343/702 |
| 2004/0125029 | A1 | 7/2004 | Maoz et al. | |
| 2009/0243944 | A1 | 10/2009 | Jung et al. | |

FOREIGN PATENT DOCUMENTS

| | | | |
|---|---|---|---|
| WO | WO 2006/134402 | A1 | 12/2006 |
| WO | WO 2007/084051 | A1 | 7/2007 |
| WO | WO 2009/037353 | A1 | 3/2009 |

* cited by examiner

*Primary Examiner* — Hoang V Nguyen
(74) *Attorney, Agent, or Firm* — Birch, Stewart, Kolasch & Birch, LLP

(57) ABSTRACT

According to an embodiment of the present invention, the mobile terminal includes, a terminal body, a printed circuit board (PCB) mounted in the interior of the terminal body, and an internal antenna connected to the PCB, and configured to transmit and receive signals, wherein the internal antenna includes a ground formed on the PCB, a radiator connected to the ground and configured to be operable at a first band, and to feed the signals to the PCB, and a ground extension part extending in at least one direction from the ground, and configured to expand a ground surface of the ground in order for the internal antenna to include a second band, which is lower than a first band, as an operation band.

18 Claims, 13 Drawing Sheets

MOBILE TERMINAL

CROSS REFERENCE TO RELATED APPLICATIONS

The present application claims priority to Korean Application No. 10-2009-0134762 filed in Korea on Dec. 30, 2009, the entire contents of which is hereby incorporated by reference in its entirety.

BACKGROUND OF THE INVENTION

1. Field of the Invention

The present invention relates to a mobile terminal having an internal antenna operable at a plurality of bands.

2. Description of the Related Art

A mobile terminal is a device that can be carried around and has one or more functions such as voice and video call communication, inputting and outputting information, storing data, and the like.

As such functions become more diversified, the mobile terminal can support more complicated functions such as capturing images or video, reproducing music or video files, playing games, receiving broadcast signals, and the like. By comprehensively and collectively implementing such functions, the mobile terminal may be embodied in the form of a multimedia player or device.

Recently, as the technique related to high-speed communication is advancing, mobile terminals are able to transmit an receive high capacity data beyond the capability of voice communication, and accordingly, the frequency bands at which antennas employed in mobile terminals are also increasing.

To this end, an antenna mounting space of mobile terminals must be necessarily increased, which, however, runs counter to the trend that mobile terminals are becoming more compact and thinner. Thus, a structure for a antenna that is capable of satisfying desired antenna performance within a limited mounting space while implementing an antenna performance allowing antenna to be operated in a plurality of bands is required.

SUMMARY OF THE INVENTION

Accordingly, one object of the present invention is to provide a mobile terminal having an input method which is different from the conventional one.

An aspect of the present invention provides a mobile terminal including a terminal body, a printed circuit board (PCB) mounted in the interior of the terminal body, and an internal antenna connected to the PCB, wherein the internal antenna include: a ground formed on the PCB; a radiator connected to the ground and configured to be operable at a first band; and a ground extension part extending in at least one direction from the ground and expanding a ground face of the ground such that the internal antenna can include a second band, which is lower than the first band, as an operation band.

The ground extension part may include: a first extension portion extending by a certain length in a first direction from one side of the ground; and a second extension portion bent from an end portion of the first extension portion and extending in a second direction.

The first direction may be a thicknesswise direction or a widthwise direction of the terminal body, and the second direction may be a lengthwise direction of the terminal body.

A metal member may be mounted on the body to form the second extension portion, and a connection terminal connected with the metal member is disposed on the circuit board in order to form the first extension portion.

The metal member may be disposed in a lengthwise direction of the body along the side of the body in the interior of the body.

The body may include a front case and a rear case coupled to confine an internal space, and the metal member may be disposed between the front case and the rear case to form the rim exposed from the body.

The radiator may be positioned to be spaced apart from the ground, and the length of the first extension portion may correspond to the interval between the ground and the radiator.

The second extension portion may extend by a certain length in a state of maintaining a certain interval from the ground, or may extend in a meander form or a spiral form.

The first band may include a plurality of bands, and the second band may be a low frequency band lower than the lowermost band of the plurality of bands.

A mobile terminal comprising, a terminal body, a printed circuit board (PCB) mounted in the interior of the terminal body, and an internal antenna connected to the PCB, and configured to transmit and receive signals, wherein the internal antenna includes ground formed on the PCB, a radiator connected to the ground and configured to be operable at a first band, and to feed the signals to the PCB, and a ground extension part extending in at least one direction from the ground, and expanding a ground surface of the ground for the internal antenna can include a second band, which is lower than a first band, as an operation band.

The mobile terminal of claim 7, wherein the PCB and the metal member are electrically connected when the PCB and the metal member are fastened by a screw.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DETAILED DESCRIPTION OF THE INVENTION

A mobile terminal according to exemplary embodiments of the present invention will now be described with reference to the accompanying drawings. In the following description, usage of suffixes such as 'module', 'part' or 'unit' used for referring to elements is given merely to facilitate explanation of the present invention, without having any significant meaning by itself.

The mobile terminal described in the present invention may include mobile phones, smart phones, notebook computers, digital broadcast receivers, PDAs (Personal Digital Assistants), PMPs (Portable Multimedia Player), navigation devices, and the like.

Figure 1:
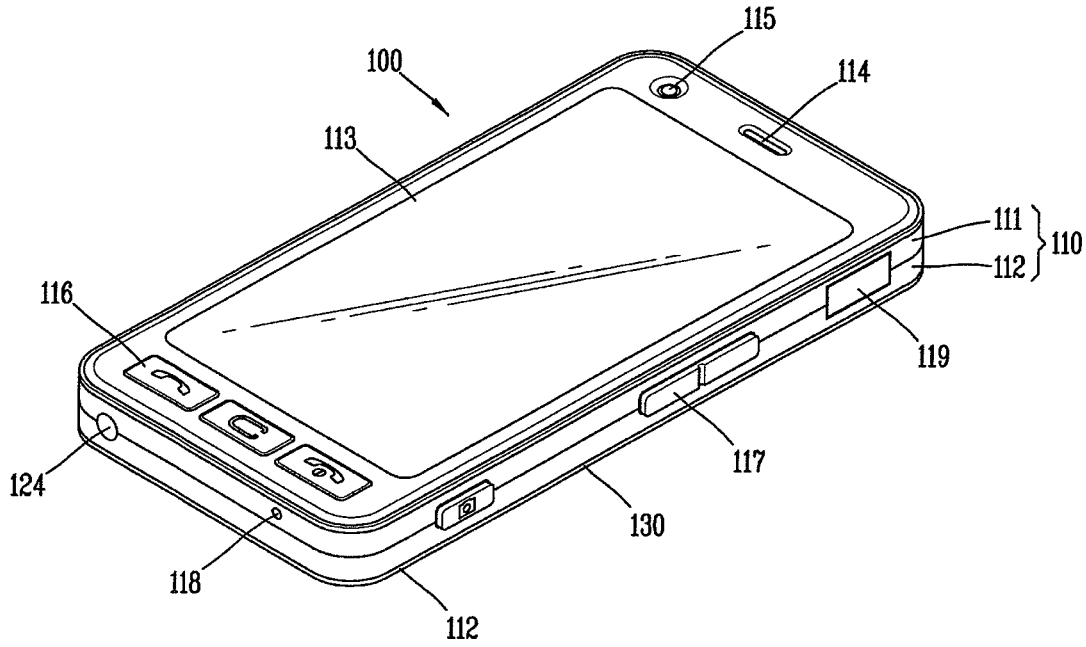
FIG. 1 is a front perspective view of a mobile terminal according to an exemplary embodiment of the present invention.

FIG. 1 is a front perspective view of a mobile terminal according to an exemplary embodiment of the present invention.

A case (housing, casing, cover, etc.) constituting the external appearance of the terminal body 110 comprises a front case 111 and a rear case 112, and various electronic components may be installed in a space formed by the front case 111 and the rear case 112.

At least one intermediate case may additionally be disposed between the front case 111 and the rear case 112.

The cases can be formed by injection-molding a synthetic resin, or made of a metallic material such as stainless steel (STS), titanium (Ti), or the like.

On the terminal body 110, there may be disposed a display unit 113, a first audio output unit 114, a first video input unit 115, first and second manipulation units 116 and 117, an audio input unit 118, an interface 119, and the like, may be disposed.

The display unit 113 may include a liquid crystal display (LCD) module, an organic light emitting diode (OLED) module, and the like, that visually expresses information.

The display unit 113 may further include a touch sensor so as to allow a user to input information in a tactile manner. Here, the display unit 113 may display visual information such as numbers, characters, symbols, and the like, to allow for inputting of a phone number or the like, and the user may input information by touching visual information displayed on the display unit 113.

The first audio output unit 114 may be implemented as a receiver or a speaker. The first audio output unit 114 is disposed at one end of the terminal body 110 so as to be positioned near a user's ear.

The first video input unit 115 may be implemented in the form of a camera module, or the like, for allowing for capturing images or video of the user and so on.

The first and second manipulation unit 116 and 117 may receive a command input to control the operation of the mobile terminal 100. The first and second manipulation units 116 and 117 may employ any types of manipulation units may be employed so long as they can be operated by the user in a tactile manner.

For example, the manipulation portion can be implemented as a dome switch or touch pad which can receive information or commands input by the user in a pushing or touching manner, or implemented in a manner of using a wheel, a jog or a joystick to rotate keys.

In terms of functions, the first manipulation unit 116 may be configured to input commands such as START, END, SCROLL, or the like, and the second manipulation unit 117 may be configured to have a function of adjusting the size of a sound outputted from the first audio output unit 114 and a function of activating or deactivating a touch recognition mode of the display unit 113.

The audio input unit 118 may be configured in the form of, for example, a microphone so as to receive user's voice, other sounds, and the like.

The interface 119 may be a passage for the mobile terminal 100 and external devices to exchange data, and the like, with each other. For example, the interface 119 may be at least one of a wired/wireless access terminal for earphones, a short-range communication port (e.g., IrDA port, Bluetooth port, wireless LAN port, and the like), and power supply terminals for supplying power to the mobile terminal.

The interface 119 may be a card socket for accommodating an external card such as Subscriber Identification Module (SIM), User Identity Module (UIM), memory card for storing information, or the like.

Figure 2:
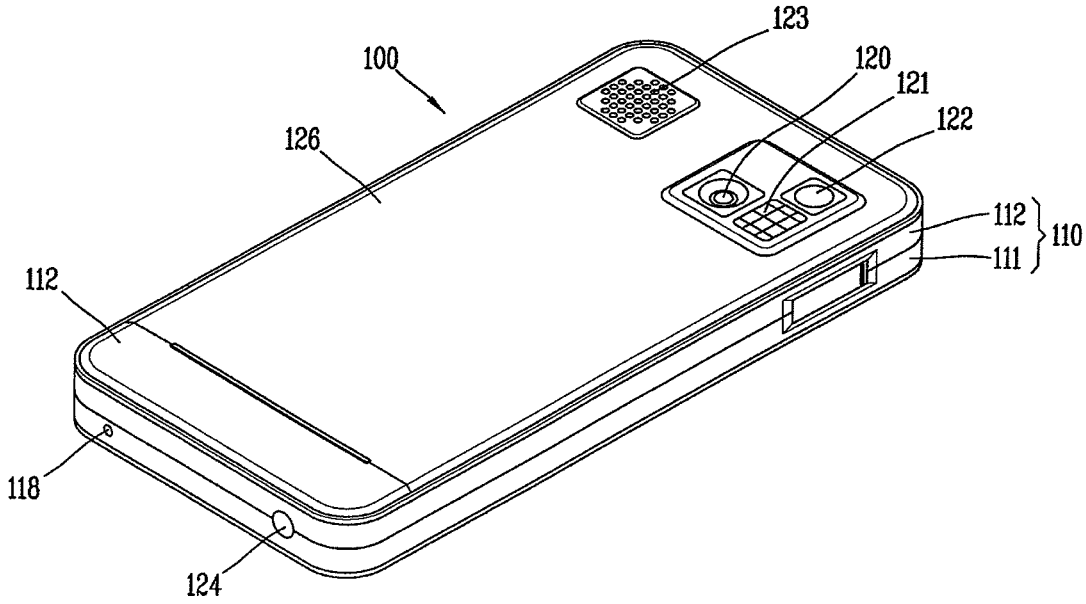
FIG. 2 is a rear perspective view of the mobile terminal according to an exemplary embodiment of the present invention.

FIG. 2 is a rear perspective view of the mobile terminal shown in FIG. 1.

As shown in FIG. 2, a second video input unit 120 may further be disposed on the rear surface of the terminal 110. The second video input unit 120 faces a direction which is substantially opposite to a direction faced by the first video input unit 115 (see FIG. 1). Also, the second video input unit 128 may be a camera having different pixels from those of the first video input unit 115.

For instance, the first video input unit 115 may operate with relatively lower pixels (lower resolution). Thus, the first video input unit 115 may be useful when a user can capture his face and send it to another party during a video call or the like. On the other hand, the second video input unit 120 may operate with relatively higher pixels (higher resolution) such that it can be useful for a user to obtain higher quality pictures for later use.

A flash 121 and a mirror 122 may be disposed adjacent to the second video input unit 120. The flash 121 operates in conjunction with the second video input unit 120 when taking a picture using the second video input unit 120. The mirror 122 can cooperate with the second video input unit 120 to allow a user to photograph himself in a self-portrait mode.

A second audio output unit 123 may be additionally disposed on the rear surface of the terminal body 110. The second audio output unit 123 may implement a stereo function along with the first audio output unit 114 (See FIG. 1) and may be used for call communication in a speaker phone mode.

A power supply unit 125 (See FIG. 8) for supplying power to the mobile terminal 100 is mounted on the rear case 112, and the power supply unit 125 may be implemented in the form of a battery 125 that can be rechargeable according to an exemplary embodiment of the present invention. A battery cover 126 may be detachably mounted on the rear case 112 in order to cover the battery 125.

A broadcast signal receiving antenna 124 may be disposed at one side of the terminal body 110, besides the antenna for the purpose of a call, or the like. The antenna 124 may be installed such that it can be protracted from the terminal body 110.

Figure 3:
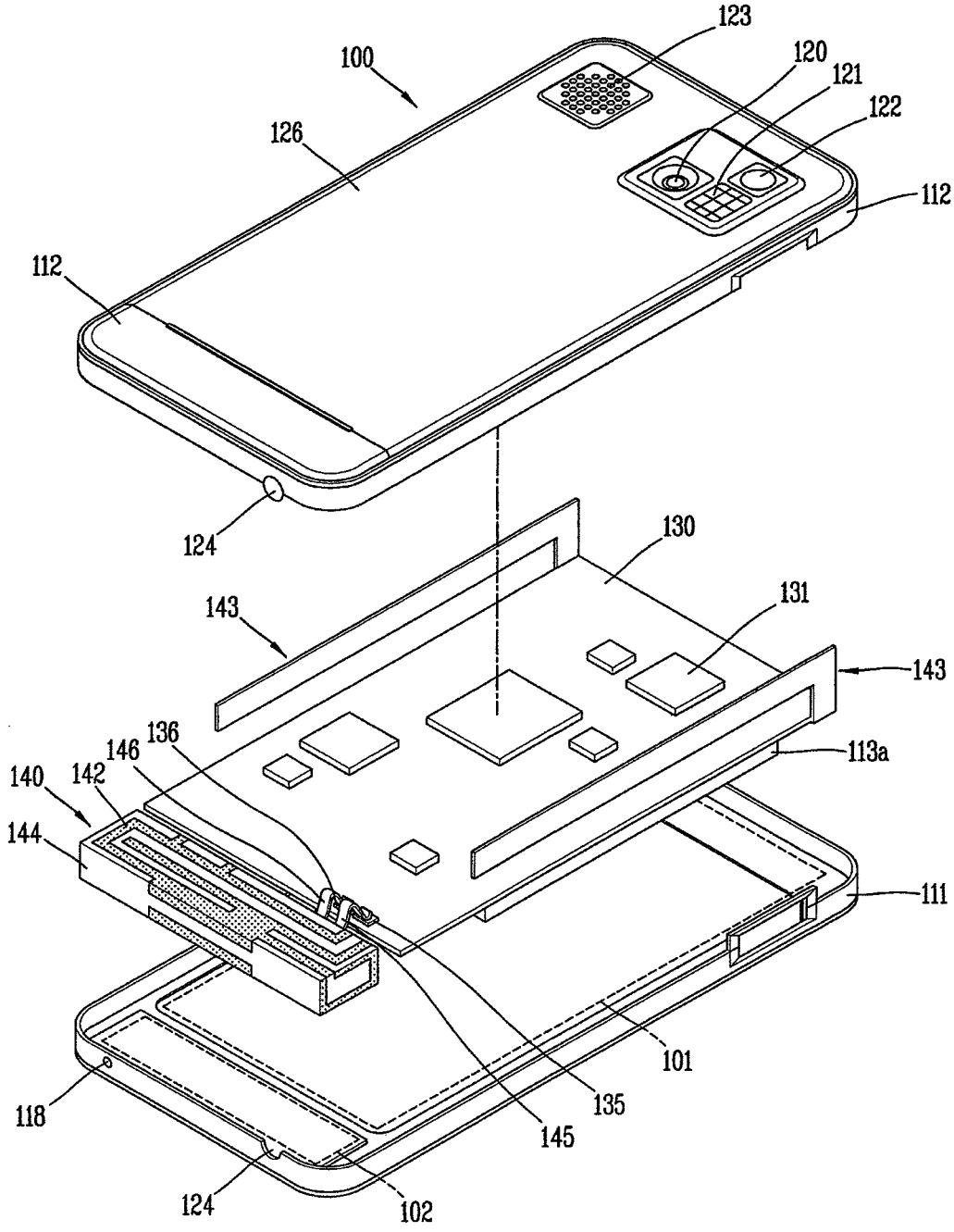
FIG. 3 is an exploded perspective view of a the mobile terminal illustrated in FIG. 2.
Figure 4:
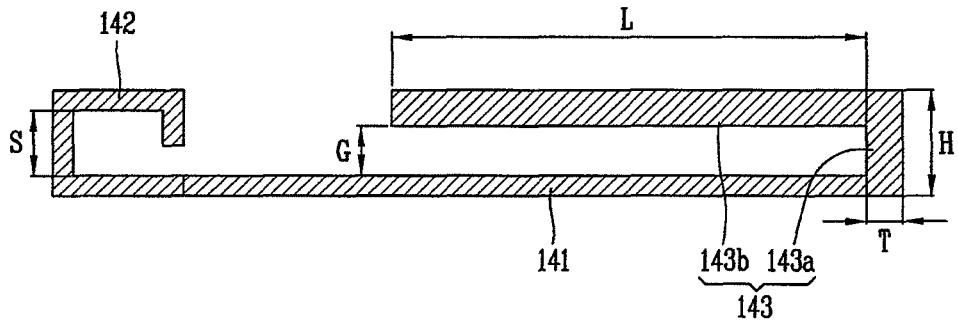
FIG. 4 is a conceptual view schematically showing the configuration of an internal antenna illustrated in FIG. 3.

FIG. 3 is an exploded perspective view of a the mobile terminal illustrated in FIG. 2, and FIG. 4 is a conceptual view schematically showing the configuration of an internal antenna illustrated in FIG. 3.

A printed circuit board (PCB) 130 is mounted between the front case 111 and the rear case 112. Electronic components 131 are mounted on at least one surface of the PCB 130 in order to operate various functions of the mobile terminal 100. For example, a display module 113*a* is mounted on one surface of the PCB 130, and a wireless communication module, a controller, and the like, may be mounted on the other surface of the PCB 130.

An internal antenna 140 is connected to one side (or one surface) of the PCB 130 in order to transmit or receive radio signals. The internal antenna 140 may include a ground 141, a radiator 142, and a ground extension part 143.

The ground 141 may have a form of a conductive plate formed on the PCB 230. In the present exemplary embodiment, the ground 141 is illustrated to be formed in the interior of the PCB 130, and an insulating material is formed on an outer side of the ground 141.

The radiator 142 serves to radiate radio waves and is configured to perform feeding on the PCB 130. The radiator 142 provides physical conditions that can be operable at first band. Namely, the radiator 142 provides physical conditions allowing a conductive metal to radiate radio waves of a first band. For example, the radiator 142 may have a particular length (e.g., a length of ½, ¼, etc., of the wavelength of the first band) to resonate radio waves of the first band, and the radiator 142 may be patterned to have a certain form on a carrier 144 to secure such a length.

The carrier 144 allows the radiator 142 to be mounted thereon, supporting the radiator 142. The carrier 144 may be configured to have a certain shape fitting the internal space of the case so as to be mounted in the interior of the case, e.g., the front and rear cases 111 and 112, of the mobile terminal, and may include a structure that can be fixed to the case or the PCB 130 so as to be maintained in a firm, fixed state.

The radiator 142 includes a ground part 145 and a feeding part 146, which are in contact with terminals 135 and 136 of the PCB 130. The radiator 142 is electrically connected with the ground 141 by means of the ground part 145. Also, the radiator 142 is configured to perform feeding on the PCB 130 through the feeding part 146.

The ground extension part 143 is made of a conductive material and extends from the ground 141 in at least one direction. As the ground extension part 143 serves to extend a ground surface of the ground 141, the antenna 140 can include a second band (here, the second band refers to a frequency band lower than the first band).

The ground extension part 143 may attach a conductor to the ground 141 or may be formed together when the ground 141 is manufacture.

The internal area of the terminal body 110 may include a first area 101 and a second area 102 positioned to be adjacent to each other. In this case, the ground 141 and the radiator 142 may be disposed at the first area 101 and the second area 102, respectively.

The ground extension part 143 may be formed within the first area 101, and a pair of ground extension parts 143 may be formed at both sides of the ground 141. In this case, the pair of ground extension parts 143 may be referred to as first and second extension portions, respectively. The first and second extension portions may have the same shape or may have different shapes.

In the present exemplary embodiment, the ground extension part 143 may be connected to the an end portion of the ground 141, namely, to an end portion opposed to the second area 102, and extends toward the second area 102.

With reference to FIG. 4, the ground extension part 143 may include a first extension portion 143*a* and a second extension portion 143*b*.

The first extension portion 143*a* may extend by a certain length in a first direction from one side of the ground 141. The first extension portion 143*a* may extend from the end portion of the ground 141, and in the present exemplary embodiment, the first direction is illustrated to follow a thicknesswise direction of the first body 110.

The second extension portion 143*b* is bent from an end portion of the first extending portion 143*a* to extend toward a second direction. In the present exemplary embodiment, the second direction is illustrated to follow a lengthwise direction of the terminal body 110, and the second extension portion 143*b* may extend toward the second area 102, namely, toward the radiator 142. The second extension portion 143*b* may extend by a certain length in a state of being maintained to have a certain gap from the ground 141.

Figure 5:
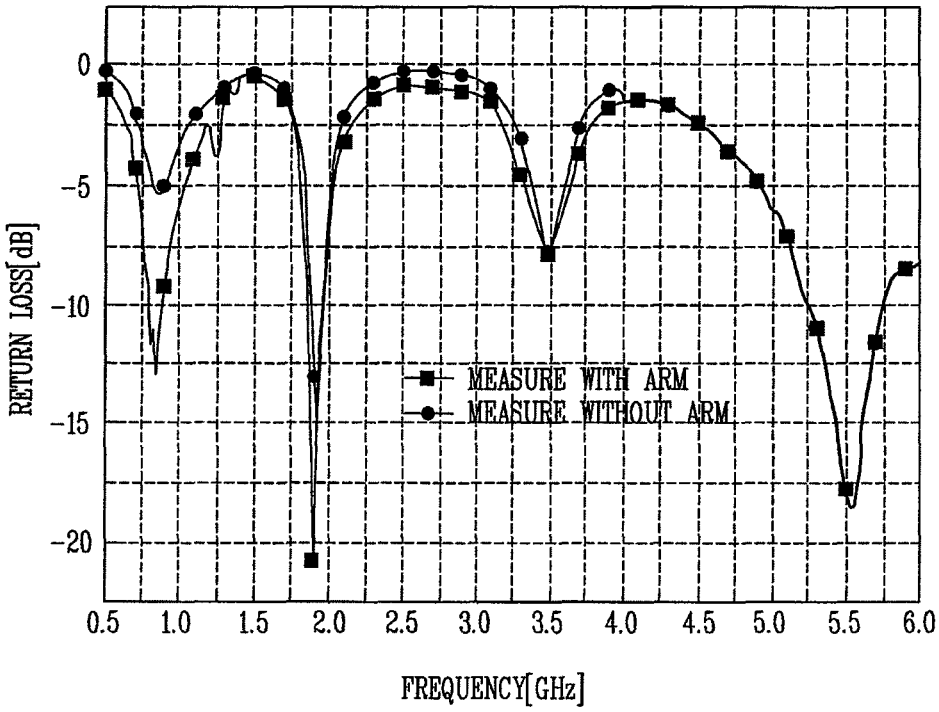
FIG. 5 is a graph showing a measurement of reflection losses when a ground extension part is applied to a ground and when the ground extension part is not applied to the ground.

FIG. 5 is a graph showing a measurement of reflection losses when a ground extension part is applied to a ground and when the ground extension part is not applied to the ground.

In the graph of FIG. 5, a curved line formed by connecting circular points shows the case in which the ground extension part 143 is not employed, and a curved line formed by connecting quadrangular points shows the case in which the ground extension part 143 is employed.

With reference to FIG. 5, a first band at which the radiator 142 can be operable may include a plurality of bands, and the plurality of bands may include, for example, at least two or more bands among CDMA/GSM 850 (824 MHz~894 MHz), GSM 900 (880 MHz~960 MHz), PCS (1850 MHz~1990 MHz), WiMax (3.4 GHz~3.6 GHz), and WLAN (5.15 GHz~5.85 GHz). In the present exemplary embodiment, the first band includes all of such bands.

A second band extended by the ground extension part 143 may be a low frequency band lower than the lowermost band of the plurality of bands. In the present exemplary embodiment, an LTE (746 MHz~805 MHz), a low frequency band, which is lower than the CDMA/GSM 850 (824 MHz~894 MHz), the lowermost band of the first band, is additionally generated.

With reference to FIG. 5, when the ground extension part 143 is applied, it is noted that a reflection loss is reduced in the LTE band, compared with the case in which the ground extension part 143 is not applied. When the reference reflection loss operable by the internal antenna is −5 dB (which description for graphs illustrated afterwards will be based on this), the ground extension part 143 may be applied to additionally form a band in the LTE band (746 MHz to 805 Mhz), so the antenna 140 can be operated in the corresponding band.

The application of the ground extension part 143 can obtain an effect of extending a ground surface of the ground 141. Thus, the substantial length of the internal antenna 140 can be extended, and currents flowing at the ground 141 can smoothly flow along the first and second extending portions 143*a* and 143*b*. The low of such currents is a key factor for causing a change in the input impedance in the LTD band (746 MHz to 805 MHz). The impedance matching characteristics of the antenna 140 can be obtained by adjusting the length (L) of the ground extension part 143. This will be described in detail later.

The frequency bands taken as examples of first and second bands in FIG. 5 are merely illustrative. The first and second bands can be variably set according to a band in which the antenna is desired to be operated.

Figure 6:
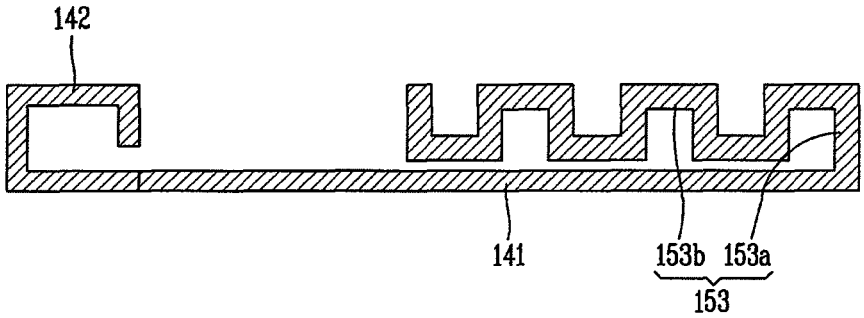
FIGS. 6 and 7 are conceptual views showing the structure of a ground extension part according to another exemplary embodiment of the present invention.
Figure 7:
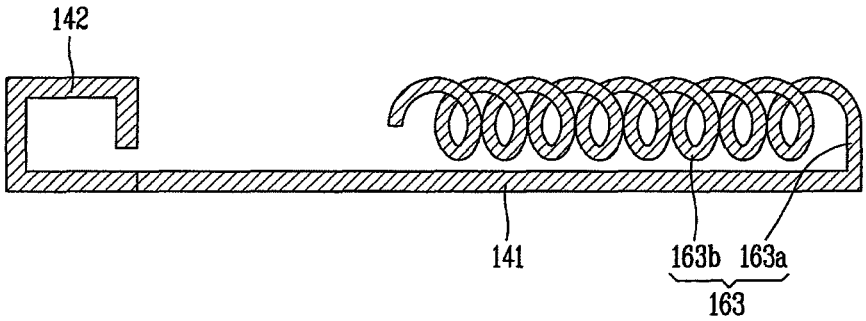

FIGS. 6 and 7 are conceptual views showing the structure of a ground extension part according to another exemplary embodiment of the present invention.

The ground extension part according to an exemplary embodiment of the present invention can be modified to have various forms as well as in the 'L'-like shape as in the former exemplary embodiment.

Like the ground extension part of the former exemplary embodiment of the present invention, ground extension parts 153 and 163 according to the present exemplary embodiment may also include first extension portions 153*a* and 163*a* and second extension portions 153*b* and 163*b*.

As shown in FIG. 6, The second extension portion 153*b* has a meander shape. Namely, the second extension portion 153*b* may extend in a repeatedly bent structure. Also, as shown in FIG. 7, the second extension portion 163*b* may extend in a spiral form.

Because the second extension portions 153*b* and 163*b* are formed to have such a form, the ground extension parts 153 and 163 can be further lengthened. This structure is advantageous in that it can secure the length of the ground extension parts 153 and 163 in a limited space when there is a restriction inn the length of the terminal body 110 or when a disposition space of the ground extension parts 153 and 163 is not sufficient.

Figure 8:
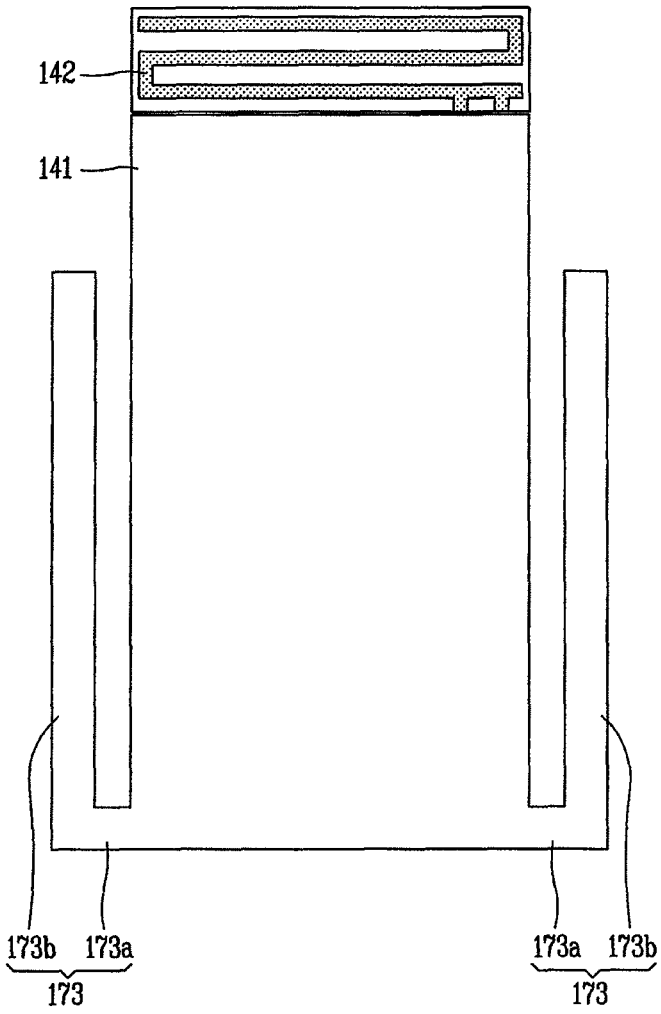
FIG. 8 is a conceptual view showing the structure of a ground extension part according to still another exemplary embodiment of the present invention.

FIG. 8 is a conceptual view showing the structure of a ground extension part according to still another exemplary embodiment of the present invention.

A ground extension part 173 according to the present exemplary embodiment includes a first extension portion 173*a* extending from a ground 171 in a first direction and a second extension portion 173*b* bent from an end portion of the first extension portion 173*a* and extending in a second direction.

In the present exemplary embodiment, unlike the former exemplary embodiment, the first direction is a widthwise direction of the terminal body 110. The second direction is illustrated to be a lengthwise direction of the terminal body 110 likewise as in the former exemplary embodiment.

The first and second extension portions 173*a* and 173*b* can have a structure extending various forms from the ground 141.

In addition, when the pair of ground extension portions 173*a* and 173*b* are formed at both sides of the ground 141, the pair of ground extension portions may have the same shape, namely, they may be symmetrical, or they may have different shapes. For example, one (e.g., the first extension portion) of the ground extension portions 173*a* and 173*b* may be formed to have an 'L'-like shape and the other (e.g., the second extension portion) may be formed in a meander form or in a spiral form.

Figure 9:
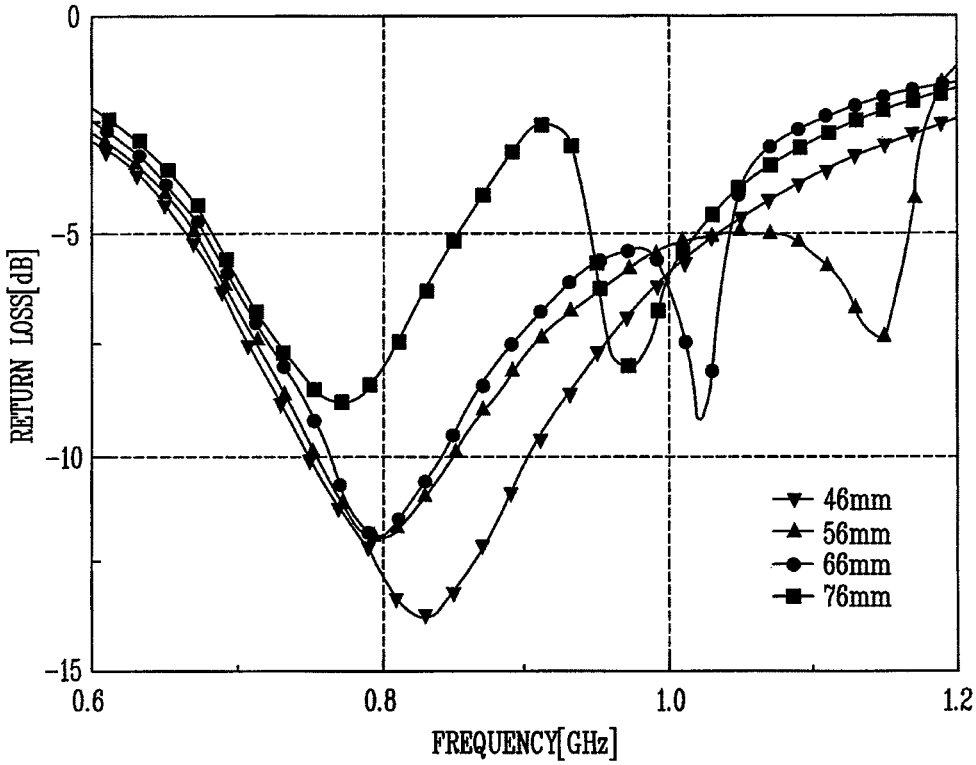
FIG. 9 is a graph of a simulated reflection loss over the length of the ground extension part.

FIG. 9 is a graph of a simulated reflection loss over the length of the ground extension part.

The graph of FIG. 9 shows reflection loses when the lengths (L) of the second extension portion 143*b* are set to be 46 mm, 56 mm, 66 mm, and 76 mm on the basis of the structure of the ground extension part 143 illustrated in FIG. 4.

With reference to FIG. 9, it is noted that the impedance matching characteristics of the second band are obtained by adjusting the length of the second extension portion 143*b*. In this case, however, the continuous increase in the length (L) of the second extension portion 143*b* does not always achieve a desired band matching. When the length of the second extension portion 143*b* is longer than a certain length, for example, when the length of the second extension portion 143*b* is 76 mm, the bandwidth in a desired frequency band is rather reduced.

Figure 10A:
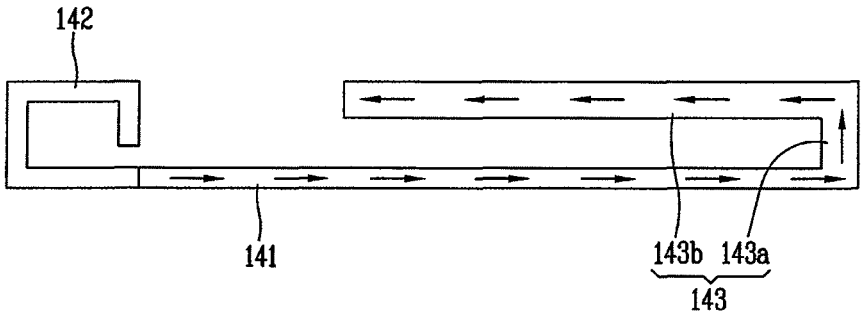
FIGS. 10A and 10B illustrate current distributions according to the length of a second extension portion.
Figure 10B:
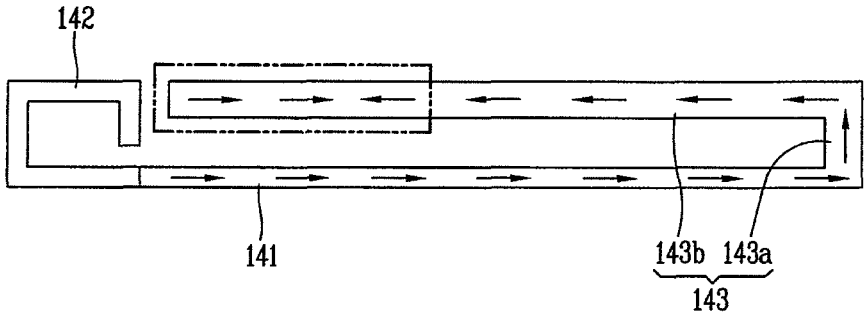

FIGS. 10*a* and 10*b* illustrate current distributions according to the length of a second extension portion.

FIG. 10A shows a case in which the length (L) of the second extension portion 143*b* is 46 mm, and FIG. 10B shows a case in which the length (L) of the second extension portion 143*b* is 76 mm.

FIG. 10A shows a case in which the length (L) of the second extension portion 143*b* is 46 mm, and FIG. 10B shows a case in which the length (L) of the second extension portion 143*b* is 46 mm. A surface current of the ground 141 smoothly flows to the end portion of the second extension portion 143*b* through the first extension portion 143*a*. However, when the length (L) of the second extension portion 143*b* is 76 mm, a surface current reversely flows from the end portion of the second extension portion 143*b*, hampering the bandwidth in the desired frequency band.

Thus, the length of the second extension portion 143*b* must be appropriately set according to a desired frequency band.

Figure 11:
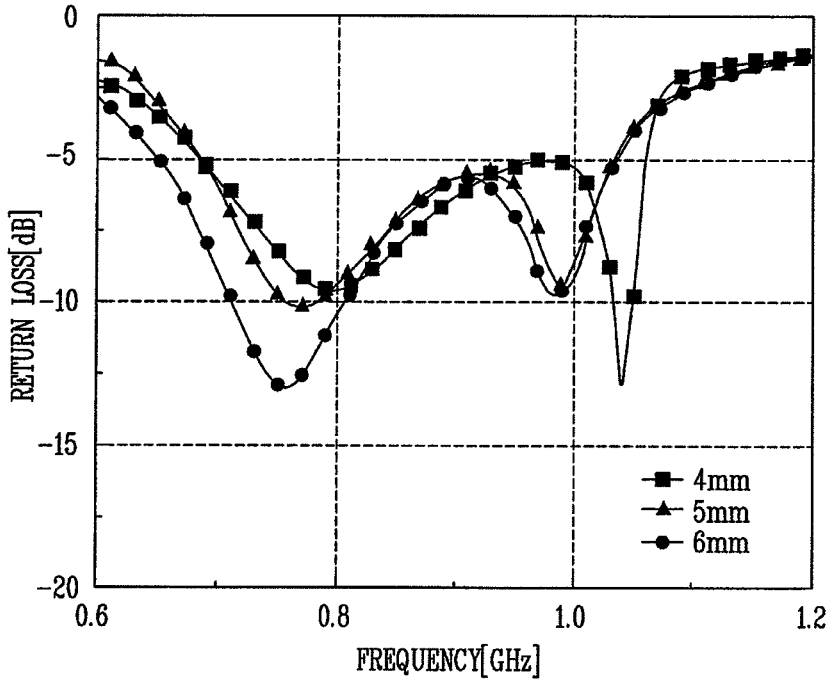
FIG. 11 is a graph showing the comparison of simulated reflection losses over the length of a first extension portion of the ground extension part.

FIG. 11 is a graph showing the comparison of simulated reflection losses over the length of a first extension portion of the ground extension part.

The graph of FIG. 11 shows reflection loses when the lengths (H) of the first extension portion 143*a* are set to be 4 mm, 5 mm, and 6 mm on the basis of the structure of the ground extension part 143 illustrated in FIG. 4.

The radiator 142 is at a position separated by a certain space (S0 from the ground 141, and in the present exemplary embodiment, the space (S) between the radiator 142 and the ground 141 is set to be 4 mm or 5 mm.

As shown in the graph of FIG. 11, it is noted that, an endless increase in the length (H) of the first extension portion 143*a* does not ensure the improvement of the impedance characteristics of the antenna 140, and when the length (H) of the first extension portion 143*a* corresponds to the space (S) or is similar to the space (S) between the radiator 142 and the ground 141, optimum reflection loss characteristics can be obtained.

Thus, in order to obtain the optimum reflection loss characteristics, preferably, the length (H) of the first extension portion 143*a* is matched to the height of the radiator 142 with respect to the ground 141. In addition, in order to minimize the thickness of the terminal body 110, preferably, the length (H) of the first extension portion 143*a* is matched to the height of the radiator 142 with respect to the ground 141.

Figure 12:
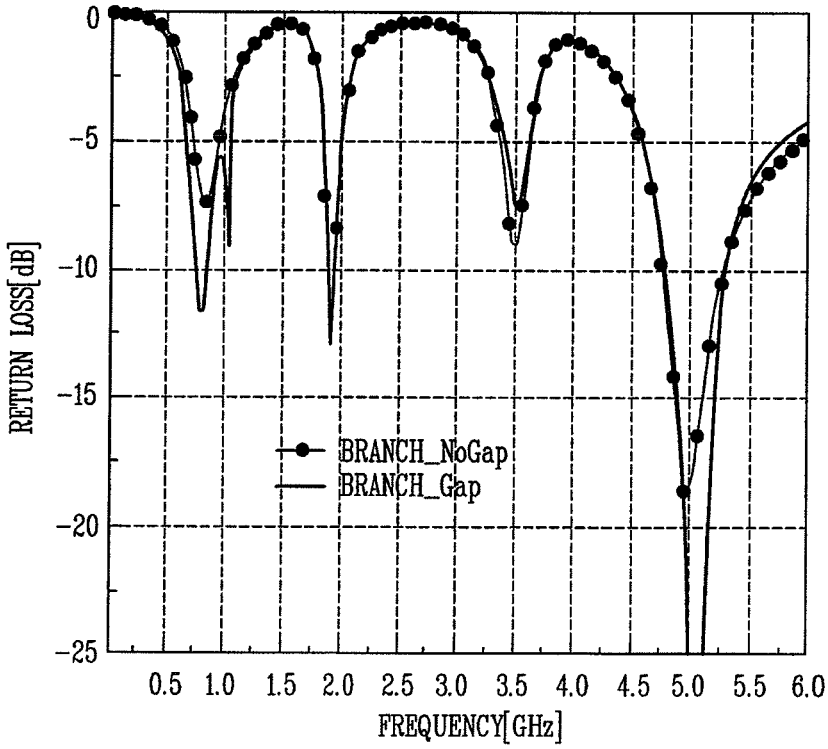
FIG. 12 is a graph showing the comparison of simulated reflection losses over the presence and absence of a gap between the second extension portion and a ground.

FIG. 12 is a graph showing the comparison of simulated reflection losses over the presence and absence of a gap between the second extension portion and a ground.

Figure 13A:
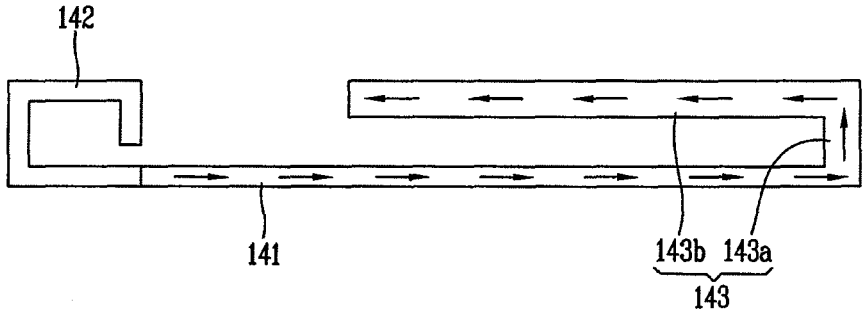
FIGS. 13A and 13B illustrate current distributions according to the presence and absence of a gap between the second extension portion and a ground.
Figure 13B:
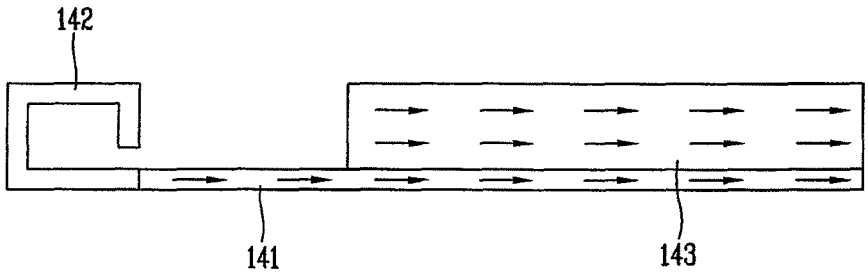

FIGS. 13A and 13B illustrate current distributions according to the presence and absence of a gap between the second extension portion and a ground.

The structure illustrated in FIG. 4 shows that the second extension portion 143*b* extends while maintaining a certain gap (G) with the ground 141. FIG. 12 shows the characteristics that the presence and absence of the gap (G) affects the reflection loss of the antenna 140. The curved line formed by connecting the points in a circular shape corresponds to a case in which the gap (G) is not formed, and a solid line indicates a case in which the gap (G) is formed. FIGS. 13A and 13B shows a case in which the gap (G) is formed between the second extension portion 143*b* and the ground 141 and a case in which there is no gap between the second extension portion 143*b* and the ground 141.

According to the graph of FIG. 12, when the gap (G) is formed between the second extension portion 143*b* and the ground 141, double resonance occurs to achieve an effect that the bandwidth in the LTE band is improved. As for a current distribution, it can be also noted that a surface current of the ground 141 smoothly flows to the end portion of the second extension portion 143*b* through the first extension portion 143*a*.

However, when the gap (G) is not formed between the second extension portion 143*b* and the ground 141, the dual resonance phenomenon does not occur, so the effect of improvement of the bandwidth cannot be achieved. This can be construed such that it is because the area of the ground surface of the ground 141 is increased in the widthwise direction, not the length of the ground surface of the ground 141. Also, seeing the current distribution is recognizing that the current direction in the ground extension part 143 is distributed in the same direction as the current direction of the ground 141, so the effect of improvement of the bandwidth cannot be achieved.

Thus, it can be noted that the formation of the gap (G) between the second extension portion 143*b* and the ground 141 is desirous in order to obtain the effect of improvement of the bandwidth.

Figure 14:
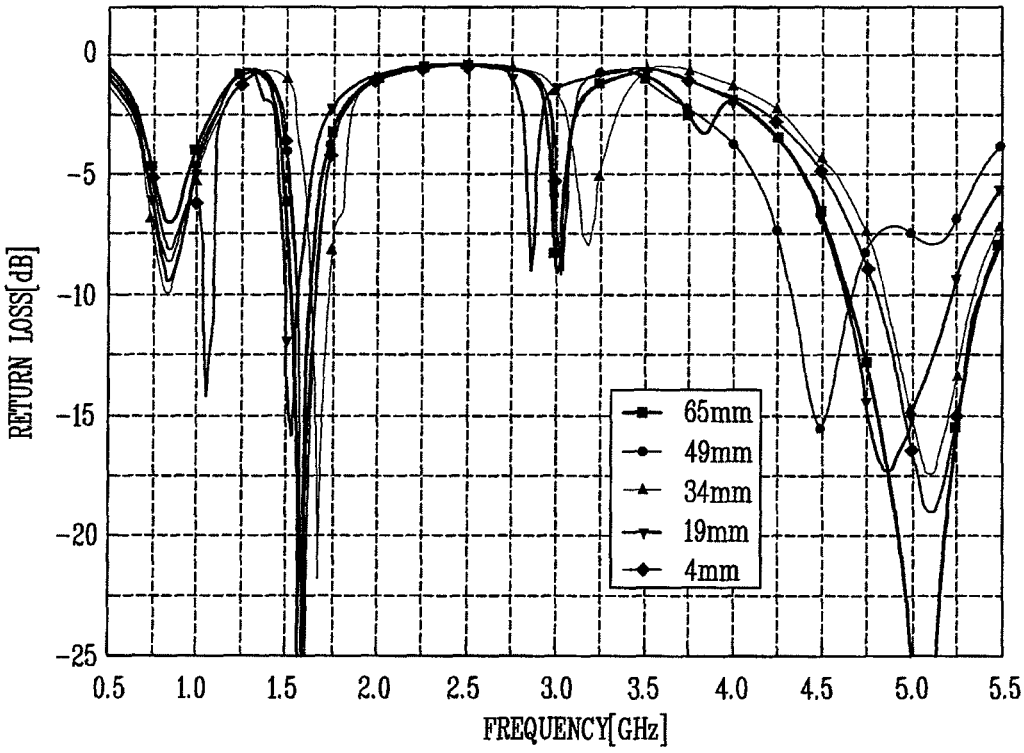
FIG. 14 is a graph showing the comparison of simulated reflection losses over the width of the first extension portion.

FIG. 14 is a graph showing the comparison of simulated reflection losses over the width of the first extension portion.

The graph of FIG. 14 shows reflection losses when the widths (W) of the first extension portion 143*a* are set to be 4 mm, 19 mm, 34 mm, 49 mm, and 65 mm on the basis of the structure of the ground extension part 143 illustrated in FIG. 4.

According to the graph of FIG. 14, it is noted that as the width (W) of the first extension portion 143*a* gradually increases from 4 mm, the dual-resonance characteristics are reduced to attenuate the effect of the improvement of the bandwidth. The increase in the width (W) of the first extension portion 143*a* works to obtain the effect of increasing the area of the ground surface of the ground 141 in the widthwise direction, and this phenomenon can be confirmed also for the case of FIG. 12.

Thus, it can be noted that the most suitable structure would be a structure in which the width of the first extension portion 143*a* is set to be a certain length or shorter and the second extension portion 143*b* extends in a state of maintaining the certain gap (G) with the ground 141.

Figure 15A:
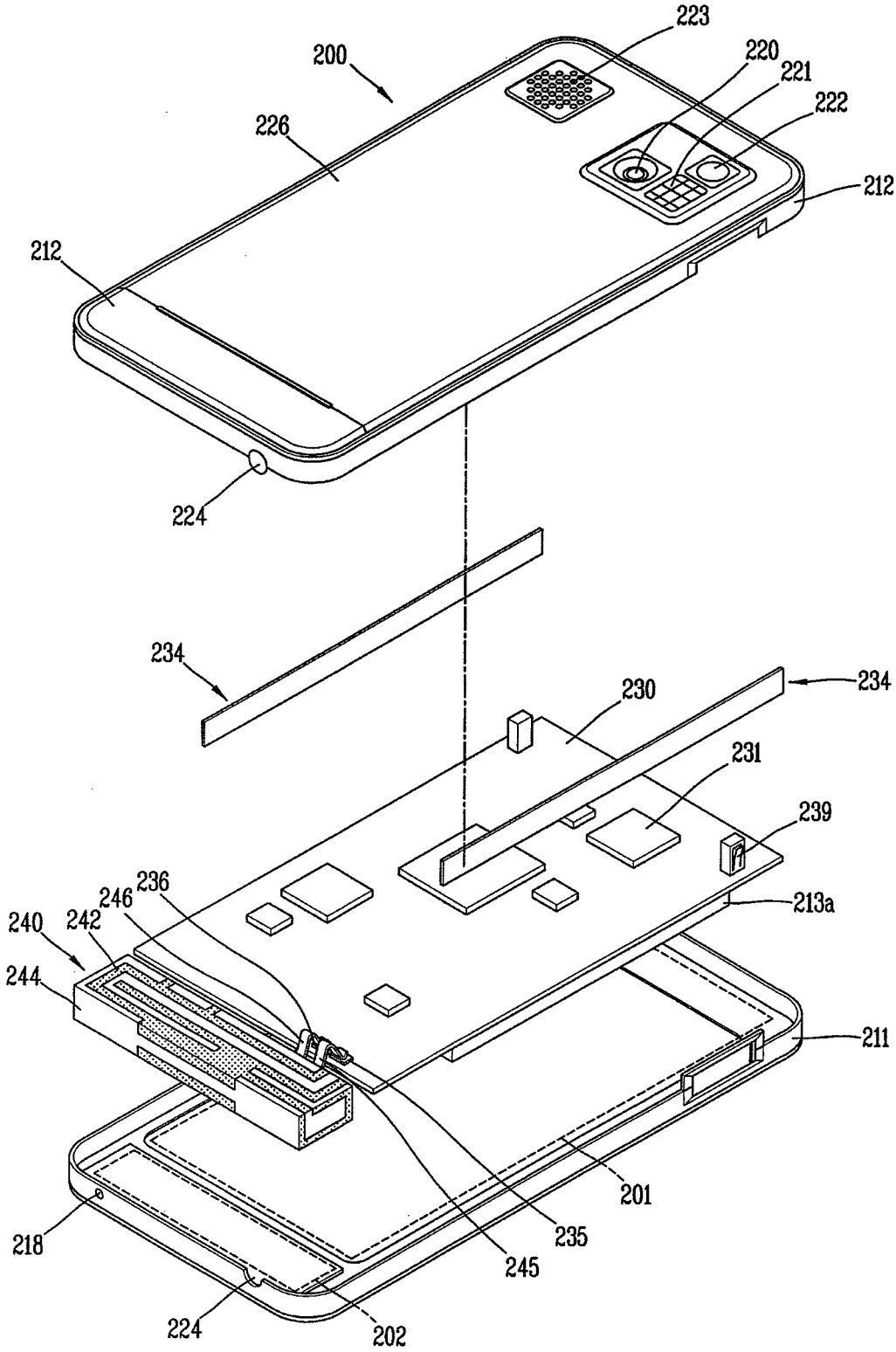
FIGS. 15A and 15B are exploded views showing a mobile terminal according to another exemplary embodiment of the present invention.
Figure 15B:
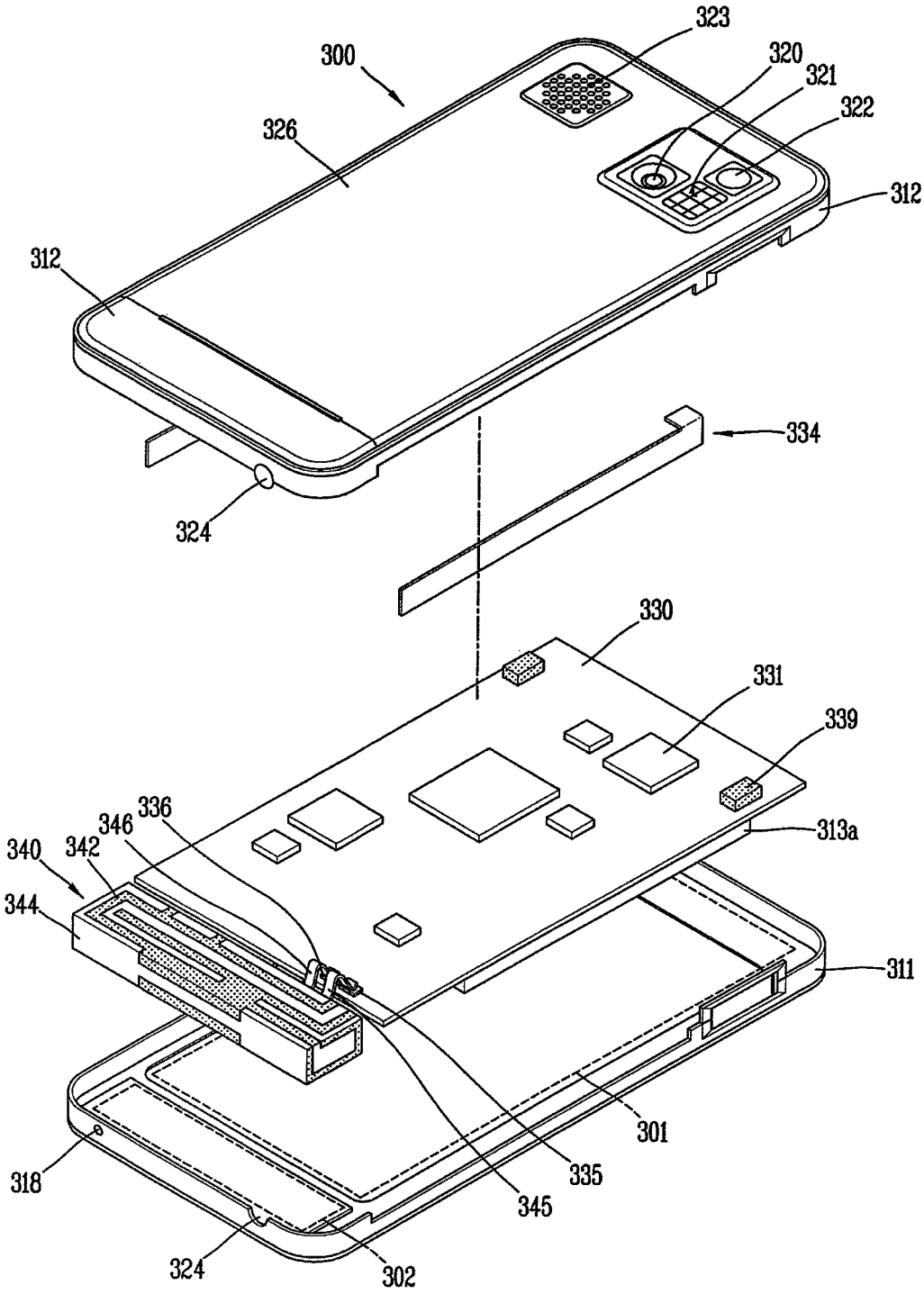

Embodiments in which the ground extension part 143 is practically applied to a terminal will now be described. FIGS. 15A and 15B are exploded views showing a mobile terminal according to another exemplary embodiment of the present invention.

With reference to FIG. 15A, a metal member 234 is mounted on the terminal body 200 in order to form a second extension portion of the ground extension part. The metal member 234 is formed as a plate member made of a metal material and disposed in a lengthwise direction of the terminal body 200 along the side of the terminal body 200 within the terminal body 200. In detail, the metal member 234 is mounted on an inner surface of the front case 211 or the rear case 212.

A connection terminal 239 to be connected with the metal member 234 may be disposed on the circuit board 230 in order to form the first extension portion. The connection terminal 239 may be formed to be elastically deformed as the metal member 234 is pressurized. For example, the connection terminal 239 may be implemented by a clip, a pogo pin, or the like. However, the present invention is not limited thereto, and the circuit board 230 and the metal member 234 may be electrically connected when they are fastened by a screw.

With reference to FIG. 15B, a metal member 334 constituting the second extension portion forms the girth exposed from a terminal body 300. Namely, the second extension portion may be a metal decoration or a metal bezel externally mounted on the body. As illustrated, the metal member 334 may be disposed between a front case 311 and a rear case 312 which are coupled to confine an internal space of the terminal body.

Openings are formed at the sides of the front case 311 and the metal member 334 is configured to cover the openings. An end portion of the metal member 334 is protruded to the interior of the terminal, and a connection terminal 339 to be connected with the end portion of the metal member 334 is disposed on the circuit board 330. The connection terminal 339 may be conductive rubber, or the like, and constitutes a first extension portion along with the end portion of the protruded metal member 334.

As described above with reference to FIGS. 15A and 15B, the ground extension part according to an exemplary embodiment of the present invention may be implemented in various forms in relation to terminals.

Figure 16:
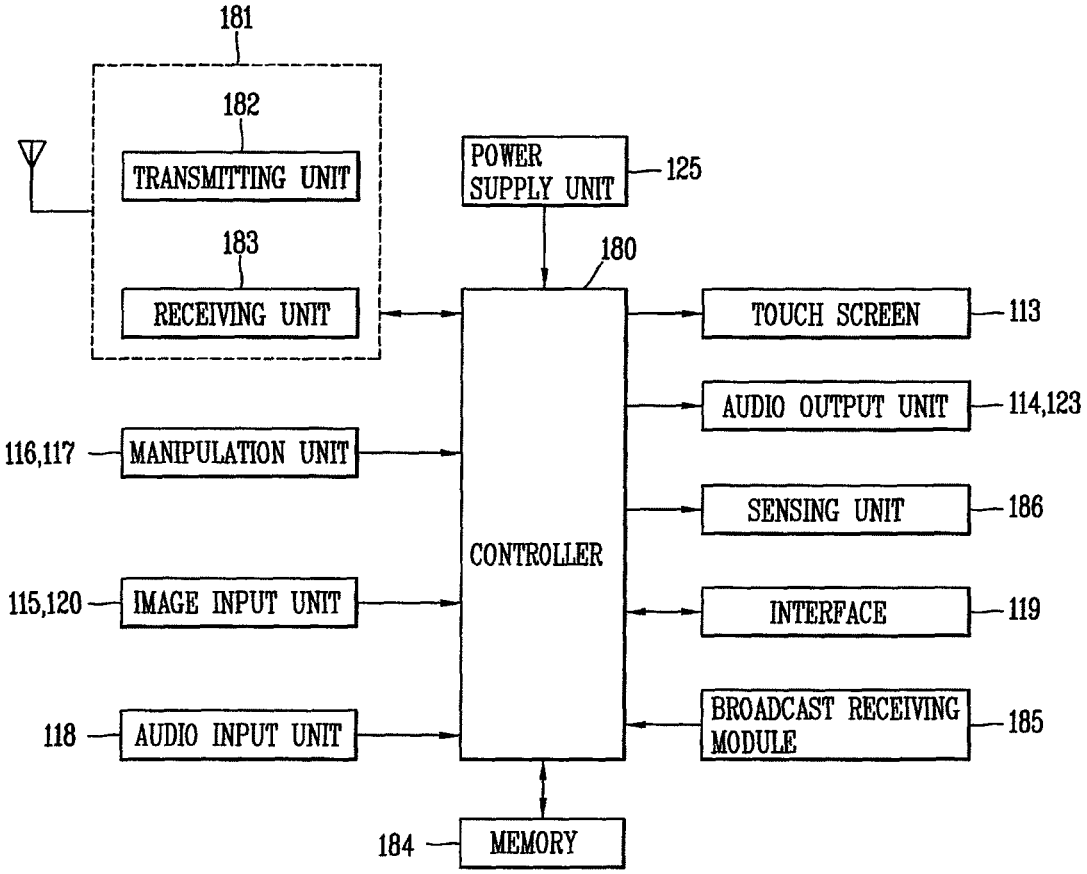
FIG. 16 is a schematic block diagram of a mobile terminal according to an exemplary embodiment of the present invention.

FIG. 16 is a schematic block diagram of a mobile terminal according to an exemplary embodiment of the present invention.

With reference to FIG. 16, the mobile terminal according to the embodiment of the present invention includes a wireless communication module 181, manipulation units 116 and 117, image input units 115 and 120, an audio input unit 118, a display unit 113, audio output units 114 and 123, a sensing unit 186, an interface 119, a broadcast receiving module 185, a memory 184, a power supply unit 125, and a controller 180.

The controller 180 controls the general operation of the mobile terminal. For example, the controller 180 performs controlling and processing related to a voice call, data communication, a video call, or the like.

The wireless communication module 181 transmits/receives a radio signal to/from a mobile communication base station via an antenna. For example, the wireless communication module 181 includes a transmitting unit 183 that handles transmission/reception of voice data, character data, image data and control data and modulates a signal to be transmitted and transmitting the modulated signal, and a receiving unit 182 that demodulates a received signal, under the control of the controller 180.

The manipulation units 116 and 117 provides key input data inputted to control the operation of the terminal.

The image input units 115 and 120 may process image frames such as still images or video acquired by an image sensor in a video call mode or an image capture mode. The processed image frames may be converted into image data that can be displayed on the display unit 113 and then outputted to the display unit 113.

The image frames processed by the image input units 115 and 120 may be stored in the memory 184 or transmitted externally via the wireless communication module 181 under the control of the controller 180.

The audio input unit 118 may receive external audio signals via a microphone in a phone call mode, a recording mode, a voice recognition mode, or the like, and process the received audio signals into electrical voice data. In the phone call mode, the processed voice data is converted into a form that can be transmitted to a mobile communication base station via the wireless communication module 181, and then transmitted to the wireless communication module 181. In the recording mode, the processed voice data is outputted to be stored in the memory 184.

The audio input unit 118 may include various types of noise canceling (or suppression) algorithms to cancel (or suppress) noise generated in the course of receiving and transmitting audio signals.

The display unit 114 may output information processed in the mobile terminal. For example, when the mobile terminal 100 is in the phone call mode, the display unit 113 may display a User Interface (UI) or a Graphic User Interface (GUI) associated with a call or other communication under the control of the controller 170. When the mobile terminal 100 is in the video call mode or the image capture mode, the display unit 113 may display a captured image, a UI, a GUI, and the like, under the control of the controller 180.

The audio output units 114 and 123 may convert audio data received from the wireless communication module 171 or stored in the memory 184 and output the converted data in a call signal reception mode, a phone call mode, a recording mode, a voice recognition mode, a broadcast reception mode, and the like, under the control of the controller 180.

Also, the audio output units 114 and 131 may provide audible outputs related to a particular function (e.g., a call signal reception sound, a message reception sound, etc.) performed by the mobile terminal. The audio output units 114 and 131 may include a speaker, a receiver, a buzzer, and the like.

The sensing unit 186 detects a current status (or state) of the mobile terminal such as an open/close state of the mobile terminal, a location of the mobile terminal, presence or absence of user contact with the mobile terminal, etc., and generates a sense (control) signal for controlling the operation of the mobile terminal. For example, the sensing unit 186 can perform a sensing function as to whether or not the power supply unit 125 supplies power or whether or not the interface 119 is coupled with an external device.

The interface 119 may serve as an interface with at least one external device connected with the mobile terminal. For example, the external devices may include wired/wireless headsets, external power chargers, wired/wireless data ports, card sockets (e.g., for receiving a memory card, a Subscriber Identity Module/User Identity Module (SIM/UIM) card, etc.), and the like. The interface 119 may be used to receive inputs (e.g., data, information, power, etc.) from an external device and transfer the received inputs to one or more elements within the mobile terminal, or may be used to transfer data from the mobile terminal to another external device.

The memory 184 may store programs or the like used for the processing and controlling performed by the controller 170, or may temporarily store inputted/outputted data (e.g., a phonebook, messages, still images, video, etc.).

Also, the memory 184 stores a program that controls the operations of the mobile terminal 100 according to the present invention.

The memory 184 may include at least one type of storage medium including a hard disk type, a card-type memory (e.g., SD or XD memory, etc), a flash memory, a Random Access Memory (RAM), a Read-Only Memory (ROM), and the like.

The broadcast receiving module 185 may receive a broadcast signal transmitted through a satellite or terrestrial means, convert the same into a broadcast data format that can be outputted to the audio output units 114 and 123 and the display units 116 and 123, and output the converted data to the controller 170. In addition, the broadcast receiving module 185 may receive supplementary data (e.g., Electronic Program Guide (EPG), a channel list, etc.) associated to a broadcast. The broadcast data and supplementary data converted by the broadcast receiving module 185 may be stored in the memory 184.

The power supply unit 125 is provided with internal or external power and supplies power required for operations of the elements under the control of the controller 180.

As so far described above, because the ground extension part is formed at the ground, broadband characteristics can be implemented in a low frequency band.

In addition, because the ground of the antenna of the terminal is structurally changed, a desired antenna performance can be obtained in a limited space without physically extending the terminal.

As the exemplary embodiments may be implemented in several forms without departing from the characteristics thereof, it should also be understood that the above-described embodiments are not limited by any of the details of the foregoing description, unless otherwise specified, but rather should be construed broadly within its scope as defined in the appended claims. Therefore, various changes and modifications that fall within the scope of the claims, or equivalents of such scope are therefore intended to be embraced by the appended claims.

What is claimed is:

1. A mobile terminal comprising:

a terminal body;

a printed circuit board (PCB) mounted in an interior of the terminal body; and an internal antenna connected to the PCB, and configured to transmit and receive signals, wherein the internal antenna includes:

a ground formed on the PCB;

a radiator connected to the ground and configured to operate at a first band, and to feed the signals to the PCB; and a ground extension part extending in at least one direction from the ground, and configured to extend a ground surface of the ground in order for the internal antenna to include a second band, which is lower than the first band, as an operation band, and wherein the ground extension part comprises a pair of first and second extension portions formed at both sides of the ground.

2. The mobile terminal of claim 1, wherein the first extension portion has a first length and extends in a first direction from one side of the ground; and the second extension portion is bent from an end portion of the first extension portion that is opposite to the ground and extends in a second direction.

3. The mobile terminal of claim 2, wherein the first direction is a thicknesswise direction or a widthwise direction of the terminal body, and the second direction is a lengthwise direction of the terminal body.

4. The mobile terminal of claim 3, further comprising:

a metal member mounted on the terminal body to form the second extension portion; and a connection terminal connected with the metal member disposed on the PCB in order to form the first extension portion.

5. The mobile terminal of claim 4, wherein the metal member is disposed in the lengthwise direction of the terminal body along the side of the terminal body in the interior of the terminal body.

6. The mobile terminal of claim 4, wherein the body comprises a front case, and a rear case coupled to the front case in order to confine an internal space, and the metal member is disposed between the front case and the rear case to form a rim exposed from the body.

7. The mobile terminal of claim 4, wherein the connection terminal is configured to be elastically deformed as the metal member is pressurized.

8. The mobile terminal of claim 7, wherein the PCB and the metal member are electrically connected when the PCB and the metal member are fastened.

9. The mobile terminal of claim 2, wherein the radiator is spaced apart from the ground, and the first length of the first extension portion corresponds to an interval between the ground and the radiator.

10. The mobile terminal of claim 9, wherein the length of the first extension portion is matched to a height of the radiator measured from the ground.

11. The mobile terminal of claim 2, wherein the second extension portion has a second length and extends from the first extension portion and a space between the second extension portion and the ground is maintained.

12. The mobile terminal of claim 2, wherein the second extension portion extends in a meander form or a spiral form.

13. The mobile terminal of claim 1, wherein the first band comprises a plurality of bands, and the second band is a low frequency band lower than a lowermost band of the plurality of bands.

14. The mobile terminal of claim 13, wherein the plurality of bands comprises two or more of a GSM/CDMA 850 band, a GSM 900 band, a PCS band, a WiMax band, and a WLAN band, and the second band may include an LTE band.

15. The mobile terminal of claim 1, wherein the pair of the first and second extension portions are formed to have the same shape or different shapes.

16. The mobile terminal of claim 1, wherein the ground is positioned at a first area and the radiator is positioned at a second area, and the first and the second areas are adjacently positioned in the interior of the terminal body.

17. The mobile terminal of claim 16, wherein the ground extension part is formed within the first area.

18. The mobile terminal of claim 16, wherein the ground extension part is connected to an end portion of the ground, that is opposite to the second area, and extends toward the second area.

* * * * *